US012044486B2

(12) United States Patent
Granryd et al.

(10) Patent No.: US 12,044,486 B2
(45) Date of Patent: Jul. 23, 2024

(54) HEAT EXCHANGING PLATE AND HEAT EXCHANGER

(71) Applicant: ALFA LAVAL CORPORATE AB, Lund (SE)

(72) Inventors: Erik Gustav Ulrik Granryd, Täby (SE); Marcello Masgrau Ghiglia, Copenhagen (DK)

(73) Assignee: ALFA LAVAL CORPORATE AB, Lund (SE)

( * ) Notice: Subject to any disclaimer, the term of this patent is extended or adjusted under 35 U.S.C. 154(b) by 37 days.

(21) Appl. No.: 16/337,008

(22) PCT Filed: Feb. 16, 2017

(86) PCT No.: PCT/EP2017/053537
§ 371 (c)(1),
(2) Date: Mar. 27, 2019

(87) PCT Pub. No.: WO2018/065124
PCT Pub. Date: Apr. 12, 2018

(65) Prior Publication Data

US 2019/0226771 A1 Jul. 25, 2019

(30) Foreign Application Priority Data

Oct. 7, 2016 (EP) ..... 16192854

(51) Int. Cl.
*F28F 3/04* (2006.01)
*F28D 9/00* (2006.01)
*F28F 13/04* (2006.01)

(52) U.S. Cl.
CPC ..... *F28F 3/042* (2013.01); *F28D 9/0037* (2013.01); *F28F 3/044* (2013.01); *F28F 3/046* (2013.01); *F28F 13/04* (2013.01)

(58) Field of Classification Search
CPC ..... F28F 3/086; F28F 3/10; F28F 3/04–048; F28F 13/02; F28F 13/06; F28F 13/12;
(Continued)

(56) References Cited

U.S. PATENT DOCUMENTS 1,747,115 A * 2/1930 Higgins ..... F28D 1/0316 165/153
2,526,157 A * 10/1950 Ramen ..... F28D 9/0006 165/82

(Continued)

FOREIGN PATENT DOCUMENTS

CN 202092498 U 12/2011
CN 105953621 A 8/2016

(Continued)

OTHER PUBLICATIONS

International Preliminary Report on Patentability, issued in PCT/EP2017/053537, dated Oct. 12, 2018.

(Continued)

*Primary Examiner* — Harry E Arant
(74) *Attorney, Agent, or Firm* — Birch, Stewart, Kolasch & Birch, LLP

(57) ABSTRACT

A plate for a heat exchanger between a first medium and a second medium, the plate being associated with a main plane of extension and a main longitudinal direction and including a first heat transfer surface, extending substantially in parallel to the main plane and arranged to be in contact with the first medium, generally flowing along the first surface in a first flow direction; and a second heat transfer surface, extending substantially in parallel to the main plane and arranged to be in contact with the second medium, generally flowing along the second surface in a second flow direction. The first surface includes protruding ridges defining at least two parallel and open-ended channels extending in the first flow direction. The second surface includes a plurality of (Continued)

protruding dimples arranged in the channels between neighbouring respective pairs of the ridges.

16 Claims, 10 Drawing Sheets

(58) Field of Classification Search
CPC ..... F28F 2250/102; F28F 2250/108; F28D 9/0031; F28D 9/0037; F28D 9/005; F28D 9/0081; F28D 2021/007; F28D 2021/0063; F28D 9/0056; F25B 39/04; F25B 39/022
See application file for complete search history.

(56) References Cited

U.S. PATENT DOCUMENTS 2,616,671 A * 11/1952 Wakeman ..... F28F 3/083 165/167
3,590,917 A * 7/1971 Huber ..... F25J 5/002 165/166
3,661,203 A * 5/1972 Mesher ..... F28F 3/083 165/167
4,043,388 A * 8/1977 Zebuhr ..... F28F 17/00 165/166
4,180,129 A * 12/1979 Sumitomo ..... F28B 1/02 165/110
4,182,411 A 1/1980 Sumitomo et al.
4,209,064 A * 6/1980 Cacalloro ..... F28D 1/0333 165/104.33
4,210,127 A * 7/1980 Kleine ..... F24S 10/506 126/670
4,503,908 A * 3/1985 Rosman ..... F28D 9/0018 165/167
4,688,631 A 8/1987 Peze et al.
4,729,428 A * 3/1988 Yasutake ..... F28F 13/12 165/166
4,911,235 A * 3/1990 Andersson ..... F28F 3/083 165/166
5,492,171 A * 2/1996 Kallrot ..... F28D 9/005 165/144
6,142,641 A * 11/2000 Cohen ..... G01B 11/2441 359/731
6,182,746 B1 * 2/2001 Wiese ..... F28D 9/005 165/166
6,389,696 B1 5/2002 Heil et al.
6,394,178 B1 * 5/2002 Yoshida ..... F28D 9/005 165/166
6,401,804 B1 * 6/2002 Shimoya ..... F28F 3/005 165/148
6,938,685 B2 * 9/2005 Duerr ..... F28D 1/0333 165/148
7,614,443 B2 * 11/2009 Usui ..... F28F 3/025 165/177
8,985,198 B2 * 3/2015 Braun ..... F28F 9/00 165/153
2002/0017372 A1 * 2/2002 Yano ..... B21C 23/10 164/113
2003/0099541 A1 * 5/2003 Lee ..... F01D 5/187 415/178
2005/0039899 A1 * 2/2005 Brost ..... F28F 1/40 165/167
2006/0048521 A1 * 3/2006 Katayama ..... B29C 59/02 62/6
2007/0006998 A1 * 1/2007 Brost ..... F28D 9/005 165/167
2007/0044946 A1 3/2007 Mehendale et al.
2007/0227697 A1 * 10/2007 Takahashi ..... H01L 23/473 165/80.4
2008/0029257 A1 2/2008 Nilsson
2008/0041556 A1 * 2/2008 Braun ..... F02B 29/0462 165/41
2008/0066895 A1 * 3/2008 Wegner ..... F28F 9/0282 165/167
2010/0024508 A1 * 2/2010 Opferkuch ..... B23P 15/26 72/252.5
2010/0044019 A1 * 2/2010 Maeda ..... F02M 26/32 165/151
2010/0175852 A1 * 7/2010 Peterson ..... H05K 7/20336 165/80.2
2011/0011568 A1 * 1/2011 Han ..... F28D 9/0043 165/133
2011/0120689 A1 * 5/2011 Tsai ..... F28F 3/046 165/185
2012/0118542 A1 5/2012 Kanzaka et al.
2012/0125583 A1 * 5/2012 Persson ..... F28D 9/005 165/170
2013/0213449 A1 * 8/2013 Parish ..... F28F 9/0265 136/205
2014/0008046 A1 * 1/2014 Persson ..... F28F 3/042 165/166
2014/0076527 A1 3/2014 Grinbergs et al.
2014/0158328 A1 * 6/2014 Persson ..... F28F 3/042 165/109.1
2014/0216702 A1 * 8/2014 Vallee ..... F28F 3/044 165/168
2014/0231054 A1 * 8/2014 Martins ..... F28F 3/08 165/166
2015/0053372 A1 * 2/2015 Seitz ..... H01M 10/625 165/41
2016/0003128 A1 * 1/2016 Berger ..... F28D 9/0056 165/145
2016/0036104 A1 * 2/2016 Kenney ..... F28F 13/08 429/120
2016/0208745 A1 * 7/2016 Neher ..... F28D 9/0043
2017/0131041 A1 * 5/2017 Blomgren ..... F28D 9/005

FOREIGN PATENT DOCUMENTS

DE 20 2007 007 169 U1 9/2008
EP 0 186 592 B1 10/1988
EP 0611941 A2 8/1994
EP 1179719 A2 * 2/2002 ..... B21C 37/0803
EP 1 091 185 A3 6/2003
EP 1376042 A3 * 6/2006 ..... F28F 3/046
EP 1 630 510 B2 3/2014
JP 52-76508 A 8/1977
JP 61-153500 A 7/1986
JP 5-280883 A 10/1993
JP 8-101000 A 4/1996
JP 2002-130977 A 5/2002
JP 2005-121319 A1 5/2005
JP 2008-511811 A 4/2008
JP 2012-107784 A 6/2012
WO WO 2009/112031 A2 9/2009
WO WO 2015/057115 A1 4/2015

OTHER PUBLICATIONS

International Search Report, issued in PCT/EP2017/053537, dated Jul. 11, 2017.
Written Opinion of the International Searching Authority, issued in PCT/EP2017/053537, dated Jul. 11, 2017.
English translation of the Chinese Office Action and Search Report, dated Apr. 2, 2020, for Chinese Application No. 201780061880.5.
English translation of the Japanese Office Action, dated Jul. 20, 2020, for Japanese Application No. 2019-518403.

* cited by examiner

HEAT EXCHANGING PLATE AND HEAT EXCHANGER

The present invention relates to a heat exchanger plate, as well as to a heat exchanger comprising a plurality of such plates. In particular, the present invention is useful in a condenser-type plate heat exchanger.

Heat exchangers of different types are used in many different applications. A particular type of prior art heat exchanger is a plate heat exchanger, in which flow channels of different media to be heat exchanged are formed between adjacent heat exchanging plates in a stack of such plates, and in particular delimited by corresponding heat exchanging surfaces on such plates.

In particular, it has turned out that plate heat exchangers can advantageously be manufactured from relatively thin, stamped sheet metal pieces, which metal pieces can be joined to form the heat exchanger. Such heat exchangers can be made relatively efficient.

The prior art comprises, inter alia, WO2009112031A3, EP1630510B2 and EP1091185A3, describing heat exchangers with plates fishbone-shaped protrusion patterns.

Furthermore, EP0186592B1 describes a plate heat exchanger with dimple-provided plates.

However, there is a problem of achieving sufficient mechanical stability in such plate heat exchangers of the above described type while still achieving sufficient heat exchanging efficiency. In particular, this is a problem in larger heat exchangers.

A further problem is to achieve sufficient heat exchanging efficiency under a certain maximum acceptable pressure drop across the heat exchanger.

Furthermore, this problem is in specifically present in condenser-type heat exchangers, such as in heat pumping and in particular refrigeration applications. Moreover, in such applications it is also desirable to minimize the amount of used refrigerant, while maintaining a high heat exchanging power and efficient condensing of the refrigerant.

Specifically regarding the conventional fishbone-shaped protrusion patterns, these provide good thermal transfer due to large contact surfaces and media turbulence. However, they have turned out not to perform well in terms of efficiency in relation to pressure drop. Also, it is difficult to design a fishbone-type plate which provides sufficient efficiency in relation to pressure drop while also keeping the amount of heat medium to a minimum.

The present invention solves the above described problems, providing a highly efficient, mechanically stable heat exchanger. In particular, for condenser-type heat exchangers, the invention provides these advantages while maintaining efficient condensing, such as of a refrigerant, while keeping the necessary amount of refrigerant to a minimum.

Hence, the invention relates to a plate for a heat exchanger between a first medium and a second medium, the plate being associated with a main plane of extension and a main longitudinal direction and comprising a first heat transfer surface, extending substantially in parallel to said main plane and arranged to be in contact with the first medium, generally flowing along the first surface in a first flow direction; and a second heat transfer surface, extending substantially in parallel to said main plane and arranged to be in contact with the second medium, generally flowing along the second surface in a second flow direction; and is characterised in that the first surface comprises protruding ridges defining at least two parallel and open-ended channels extending in the first flow direction, and in that the second surface comprises a plurality of protruding dimples arranged in said channels between neighbouring respective pairs of said ridges.

In the following, the invention will be described in detail, with reference to exemplifying embodiments of the invention and to the enclosed drawings, wherein.

Figure 1:
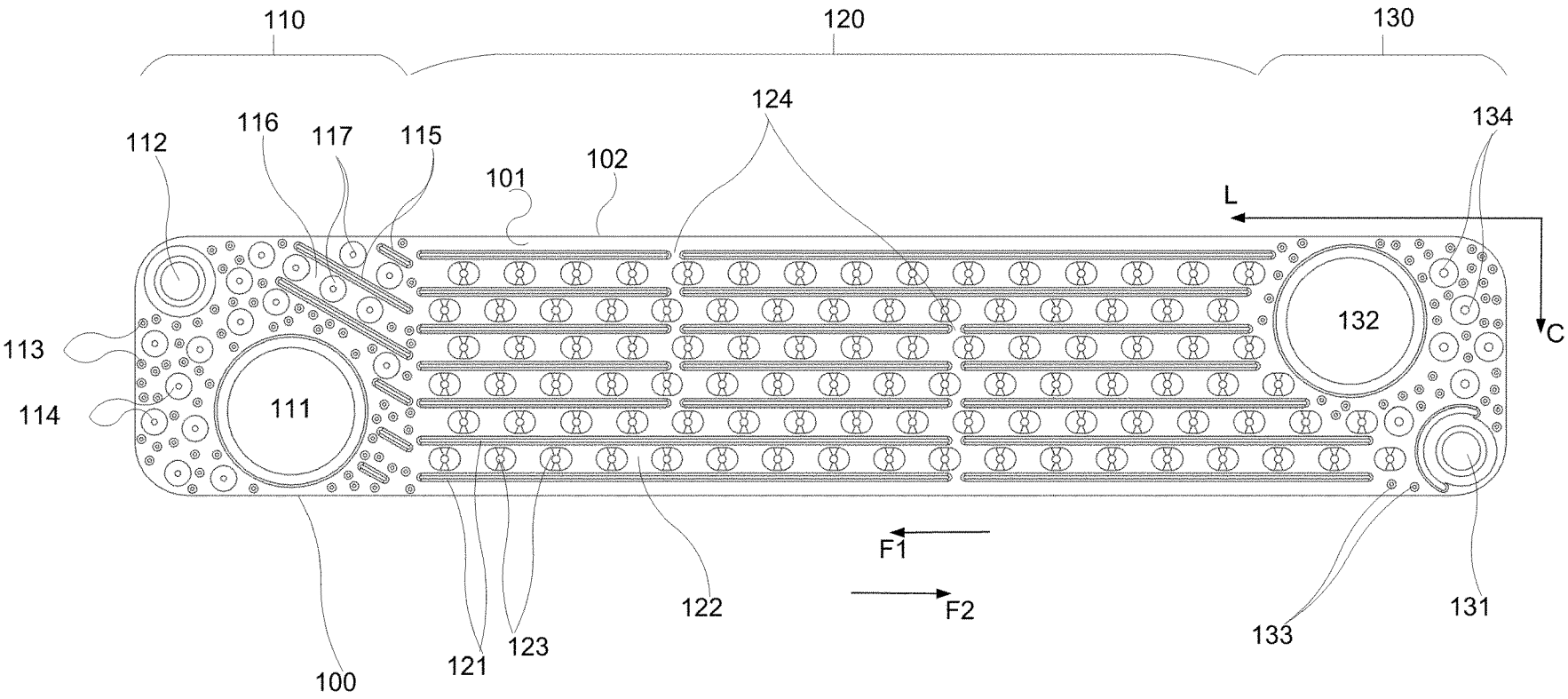
FIG. 1 is a top view of a heat exchanger plate according to a first exemplifying embodiment of the present invention.
Figure 2:
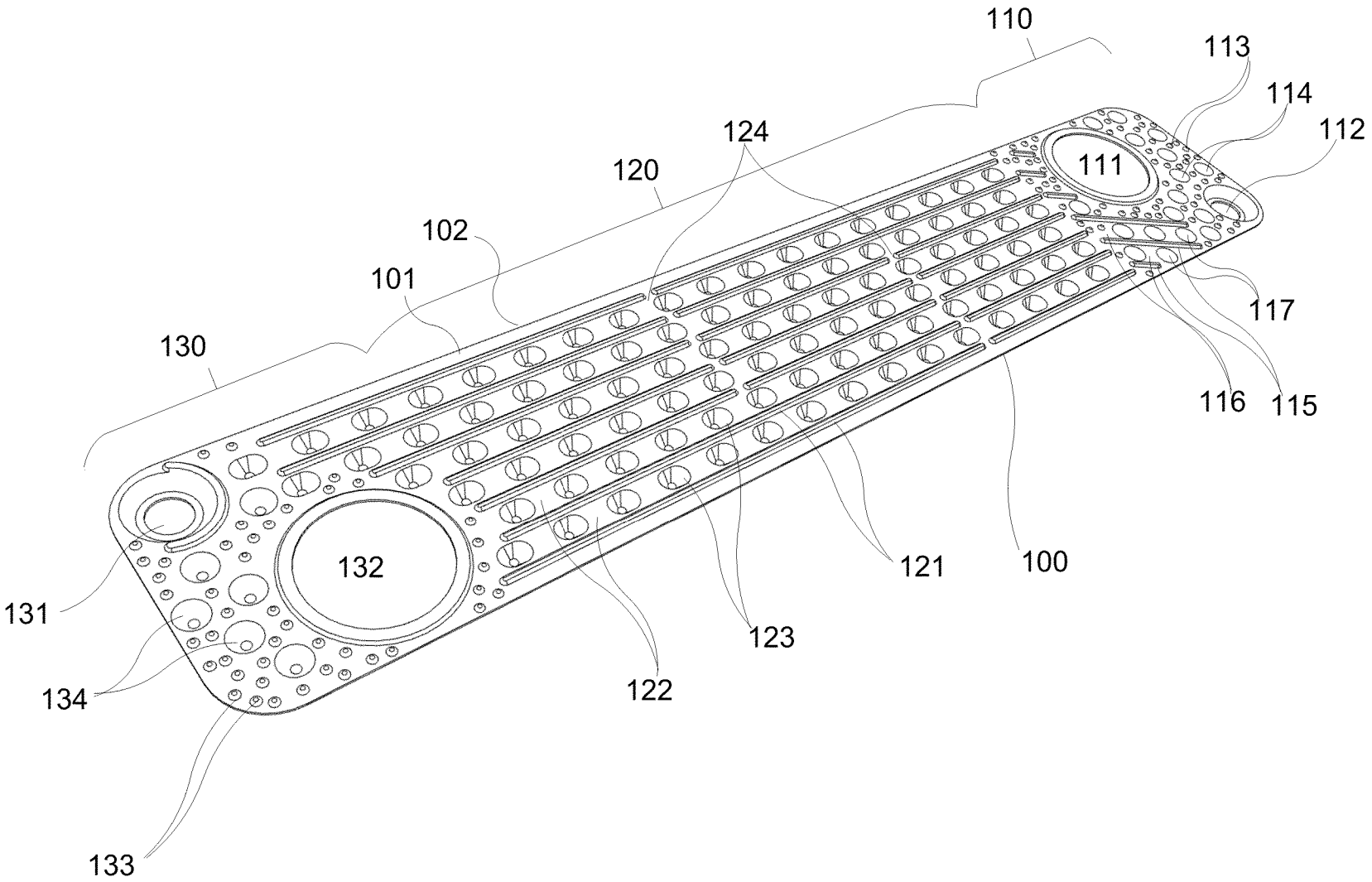
FIG. 2 is a perspective view of the heat exchanger plate shown in FIG. 1.
Figure 3:
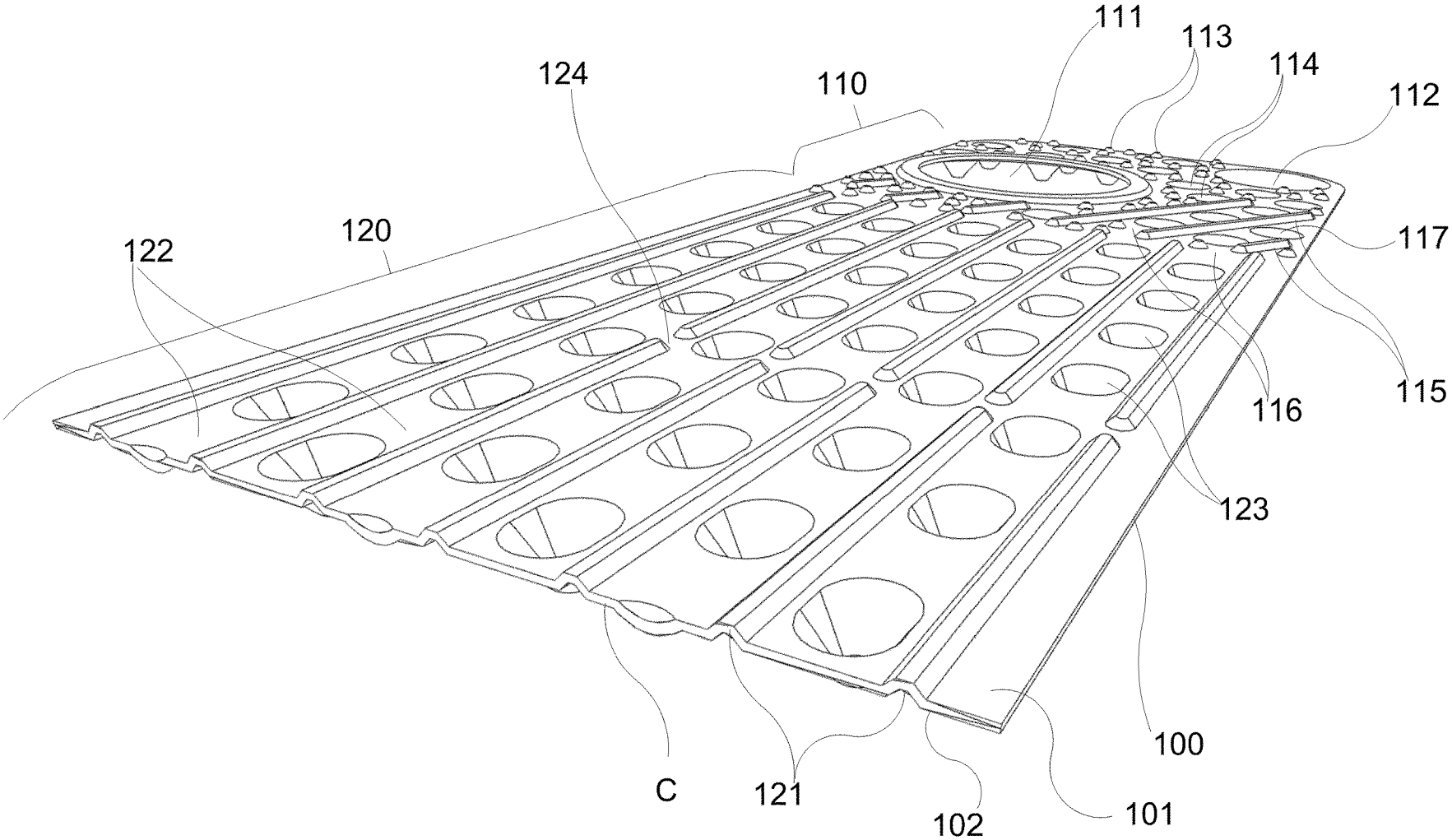
FIG. 3 is a partly removed perspective view of the heat exchanger plate shown in FIG. 1.

All Figures share a common set of reference numerals, denoting same parts. Moreover, for the two main exemplifying heat exchanging plates 100, 200 shown in the Figures, the respective two last digits in each reference numerals denote corresponding parts of these two plates, as applicable.

Hence, FIGS. 1-5 illustrate a plate 100 for a heat exchanger between a first medium and a second medium. The first and second media may each, independently of each other, be a liquid or a gas, and/or transition from one to the other as a result of a heat exchanging action taking place between said media using said plate 100 as a component part in a heat exchanger according to the invention.

The plate 100, 200 is associated with a main plane of extension, which is not indicated in the Figures but which lies in the plane of the paper in FIGS. 1, 5, 7 and 8. The plate 100, 200 is furthermore associated with a main longitudinal direction L and a cross direction C. The cross direction C is perpendicular to the main longitudinal direction L and parallel to the main plane.

The plate 100 comprises a first heat transfer surface 101, extending substantially in parallel to said main plane and arranged to be in contact with the first medium during heat exchanging, which first medium generally flows, during use of the plate 100 in said heat exchanger, along the first surface 101 in a first flow direction F1. The plate 100 furthermore comprises a second heat transfer surface 102, extending substantially in parallel to said main plane and arranged to be in contact with the second medium, generally flowing, during such use, along the second surface 102 in a second flow direction F2. Both flow directions F1 and F2 are preferably substantially parallel to the longitudinal direction L.

It is noted that the flow directions F1 and F2 illustrated in the figures are such that the plate 100 is for a counter-flow heat exchanger. It is, however, realized that the principles described herein are also applicable to parallel-flow heat exchangers, in which case F1 and F2 would be directed in the same direction, or at least in the same general direction.

The plate 100 comprises, in reverse order in the longitudinal direction L, a first region 110, a second region 120 and a third region 130. The first 110 and third 130 regions comprise media inlets and outlets, while the second region 120 is a transfer region across which the media are transported between regions 110, 130. Preferably, there are no media inlets or outlets along the transfer region 120, which preferably occupies at least half of the total length of the plate 100 in the longitudinal direction L.

The plate 100 furthermore comprises an inlet 131 for the first medium and an outlet 112 for the first medium, as well as an inlet 111 for the second medium and an outlet 132 for the second medium. These inlets 111, 131 and outlets 112, 132 may be in the form of through holes in the plate 100. In the Figures, the said through holes have circular shape. However, it is realized that any suitable shape can be used, such as quadratic shapes. Since the plates 100, 200 are preferably identical or substantially identical (apart from some being mirrored—see below regarding plates 100, 200 of first and second types), when the plates 100, 200 are stacked these through holes will align to form a tunnel with a cross-sectional shape being the same as the shape of the through holes in question. During use, when the plate 100 is mounted as one of a plurality of such plates 100 in a heat exchanger according to the invention, as described in further detail below, each of the inlets and outlets 131; 112; 111; 132 are connected to corresponding inlets/outlets of other plates in the same plate stack so as to form a general first medium inlet, first medium outlet, second medium inlet and second medium outlet port. Then, the inlet ports are arranged to distribute the first and second medium, respectively, to the inlets 131; 111 of each plate, and which outlet ports are arranged to convey the first and second medium, respectively, from the outlets 112; 132 and away from the heat exchanger.

Inlet 111 and outlet 112 are preferably completely arranged in said first region 110, while inlet 131 and outlet 132 preferably are completely arranged in the second region 130.

Along the flow direction F1, F2, the first and second medium, respectively, flow in channels formed by adjacent plates 100 in the same plate stack, between respective inlet 111, 131 and respective outlet 112, 132.

Figure 4:
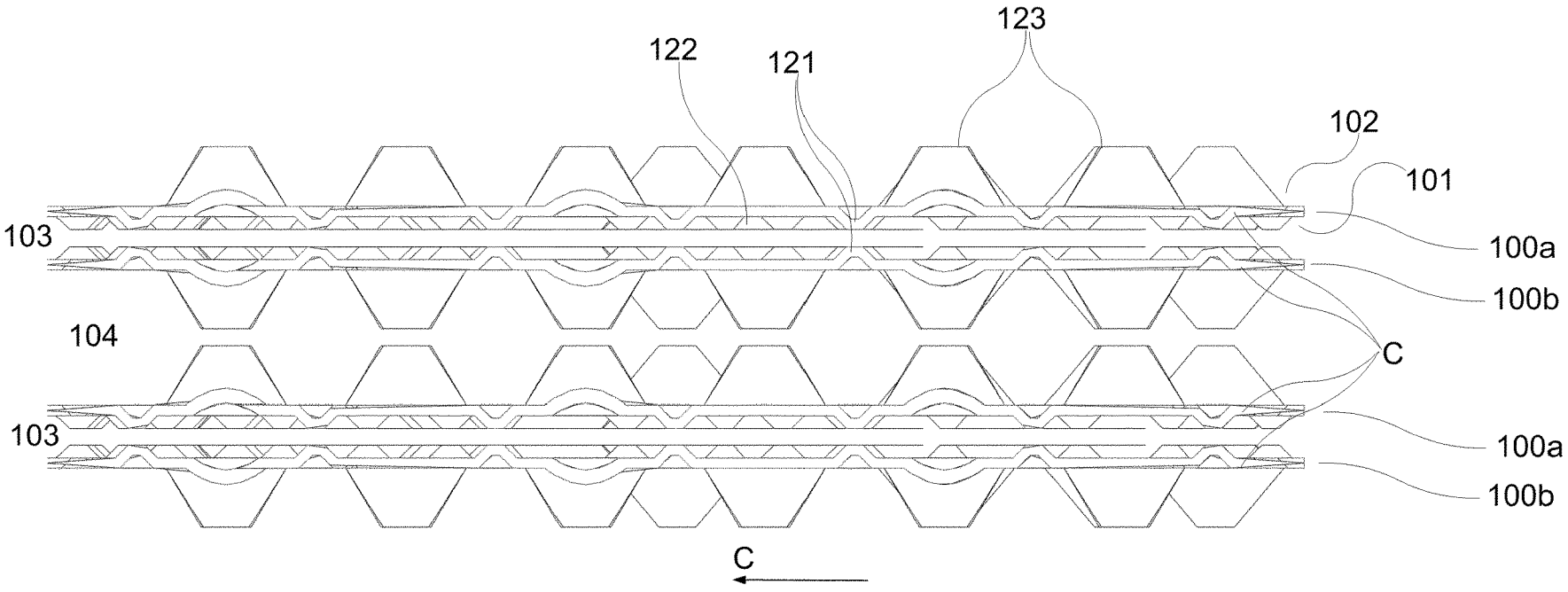
FIG. 4 is a planar side view of the cross-section face of the heat exchanger plate shown in FIG. 3, together with three additional corresponding heat exchanger plates schematically illustrating the orientation of said plates in a heat exchanger according to the invention.

More particularly, a heat exchanger according to the present invention comprises a plurality of plates 100 of two types—a first type and a second type. Plates 100 of both said first 100*a* and said second 100*b* type are as such plates of the type described herein, where the plates of said second type have a shape which is substantially mirrored, in relation to the said main plane of the plate 100 in question, to the shape of the plates of said first type. All plates of the first type may be identical within the group of first type plates, while all plates of the second type may be identical within that group. Furthermore, the plates are arranged in a stack on top of each other (stacked in a direction perpendicular to the main plane of the plates, which main planes are arranged to be parallel), with plates of said first and second type arranged alternatingly. Since the plates of first and second type are mirrored, corresponding ones of dimples and ridges arranged on adjacent plates come and stay into direct contact with each other, so that corresponding first 101 and/or second surfaces 102 of adjacent plates directly abut each other and so that flow channels 103, 104 for said first and second media are formed between said surfaces 101, 102. This is illustrated in FIG. 4, using the plate 100 and illustrated with a small distance between each pair of adjacent plates for increased clarity. In a mounted state, however, there is no distance—the plates 100 are arranged so that the dimples 123 and ridges 121 of neighbouring plates 100 come into direct contact with each other.

It is realized that the plate 200 (see below) may preferably be stacked in a corresponding manner so as to constitute component parts of a corresponding heat exchanger according to the invention. As is clear from FIG. 6, the plate 200 (in contrast to plate 100) has a bent edge 205 running around the periphery of the plate 200. The edge 205 is bent in relation to the main plane of the plate 200, and has the purpose of simplifying the process of joining the plates 200 together to form said stack of plates 200. If such a bent edge 205 is present, the edge 205 is not mirrored between plates of first and second types, as opposed to the ridges and dimples of the plate 200.

In such a heat exchanger, suitably designed end plates may be used, sealing the last plate 100, 200 in the stack on either stack end and forming a sealed heat exchanger the only inlets/outlets of which are the above described inlet and outlet ports.

Hence, each plate 100 transfers heat between the said first and second media, as a result of the first medium being transported in a channel 103 (see FIG. 4) having the first surface 101 as a limiting side wall while the second medium is transported in a channel 104 having the second surface 102 as a limiting side wall, which channels 103, 104 are only separated by said plate 100. More particularly, the first medium flows in a channel defined by opposing respective surfaces 101 of adjacent plates 100*a*, 100*b*, while the second medium with which the first medium is heat exchanged flows in a corresponding channel defined by opposing respective surfaces 102 of adjacent plates 100*b*, 100*a*. See furthermore FIGS. 9 and 10.

According to the invention, the first surface 101 comprises protruding ridges 121, defining at least two parallel and open-ended channels 122 extending in the first flow direction F1. Furthermore, the second surface 102 comprises a plurality of protruding dimples 123 arranged in said channels 122 between neighbouring respective pairs of said ridges 121.

Herein, a "ridge" refers to an elongated protruding geometric feature of the surface 101 in question on which the ridge is arranged. Preferably, such a ridge 121 in the first surface 101 is associated with a corresponding elongated indentation or recess in the opposite surface 102.

Similarly, a "dimple" refers herein to a point-like protruding geometric feature of the surface 102 in question on which the dimple in question is arranged. Preferably, such a dimple is associated with a corresponding point-like indentation or recess in the opposite surface 101. In the Figures, dimples are shown with a generally circular shape. It is, however, realized that any suitable shape, such as quadratic or octagonal, may be used, depending on application. Hence, the word "point-like" is intended to mean "with a shape, in the main plane of the plate in question, which is generally centred about a particular point rather than elongated".

Both ridges and dimples are preferably arranged with a planar top surface, arranged to abut a corresponding planar top surface of a corresponding ridge or dimples, respectively, of an adjacently arranged, mirrored heat exchanger plate.

The plate 100 is preferably manufactured from sheet metal, with a material thickness which preferably is substantially equal across the whole plate 100 main plane, and in particular across ridges 121 and dimples 123, 113, 114, 133, 134 (see below). Advantageously, the plate 100 is manufactured from a piece of sheet metal which is stamped into the desired shape.

A heat exchanging plate 100 with such a pattern of channel-forming ridges 121 and dimples 123 arranged in the formed channels 122 has been found to provide very good mechanical stability when used as a component part in a heat exchanger of the type described herein, while still being able to very efficiently transfer heat between said first and second media, across a wide range of applications. Using such a plate 100 also makes it possible for the ridges and dimples to be designed with very small height (see below), so as to achieve a heat exchanger using only a very small volume of first and/or second medium. In particular, the ridge height can be made very small, whereby the amount of first medium can be reduced. Such miniaturizing can be made without jeopardizing efficiency and pressure drop requirements.

Figure 6:
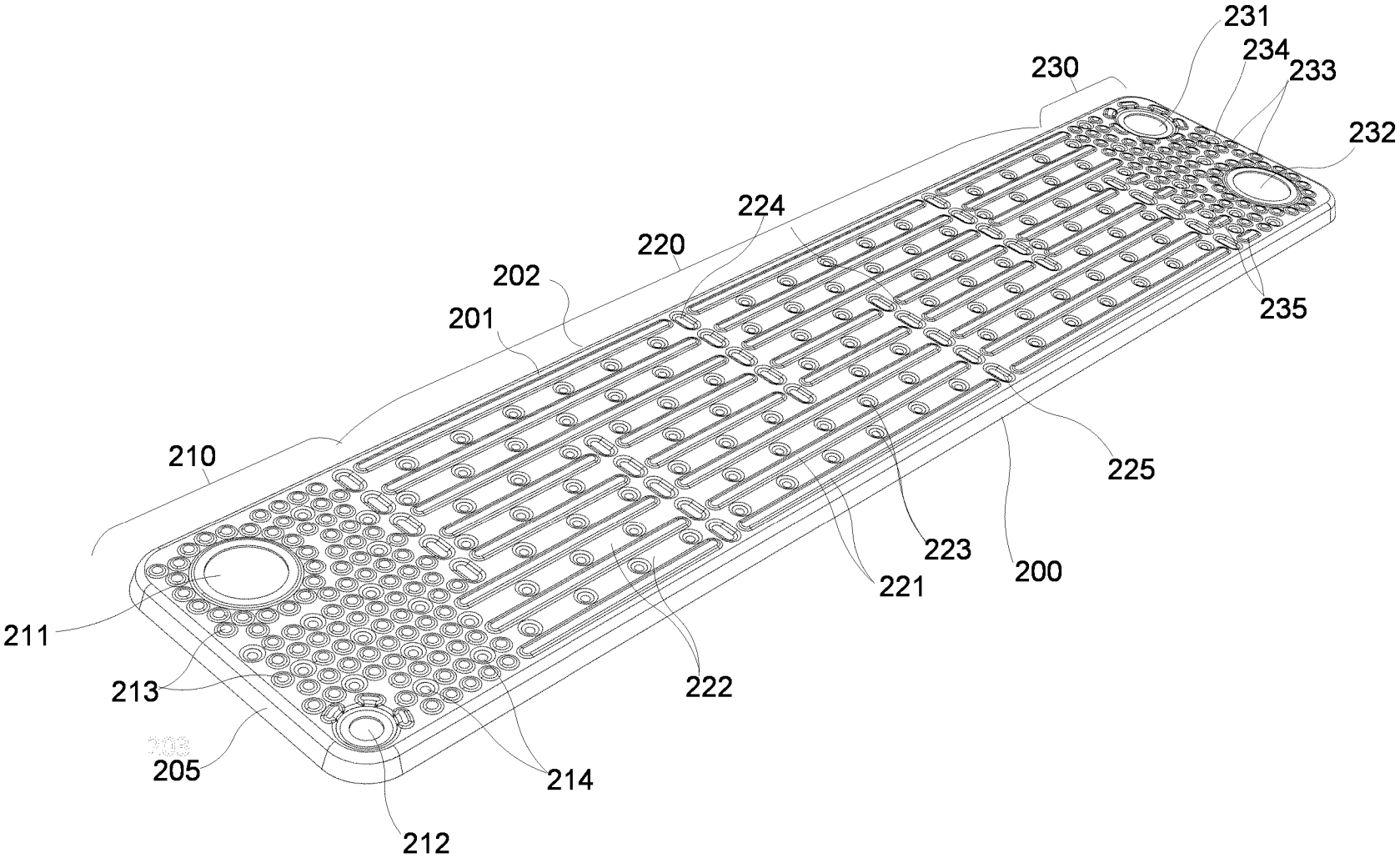
FIG. 6 is a perspective view of a heat exchanger plate according to a second exemplifying embodiment of the present invention.
Figure 7:
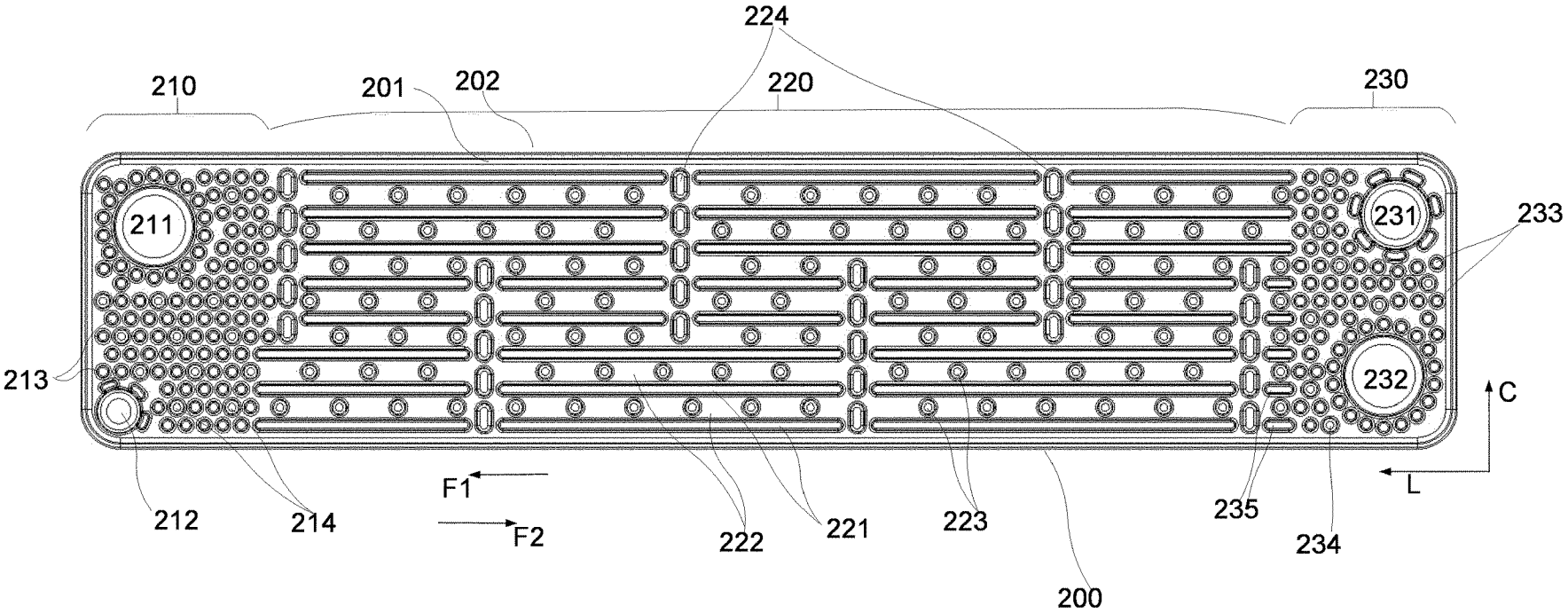
FIG. 7 is a top planar view of the heat exchanger plate shown in FIG. 6.
Figure 8:
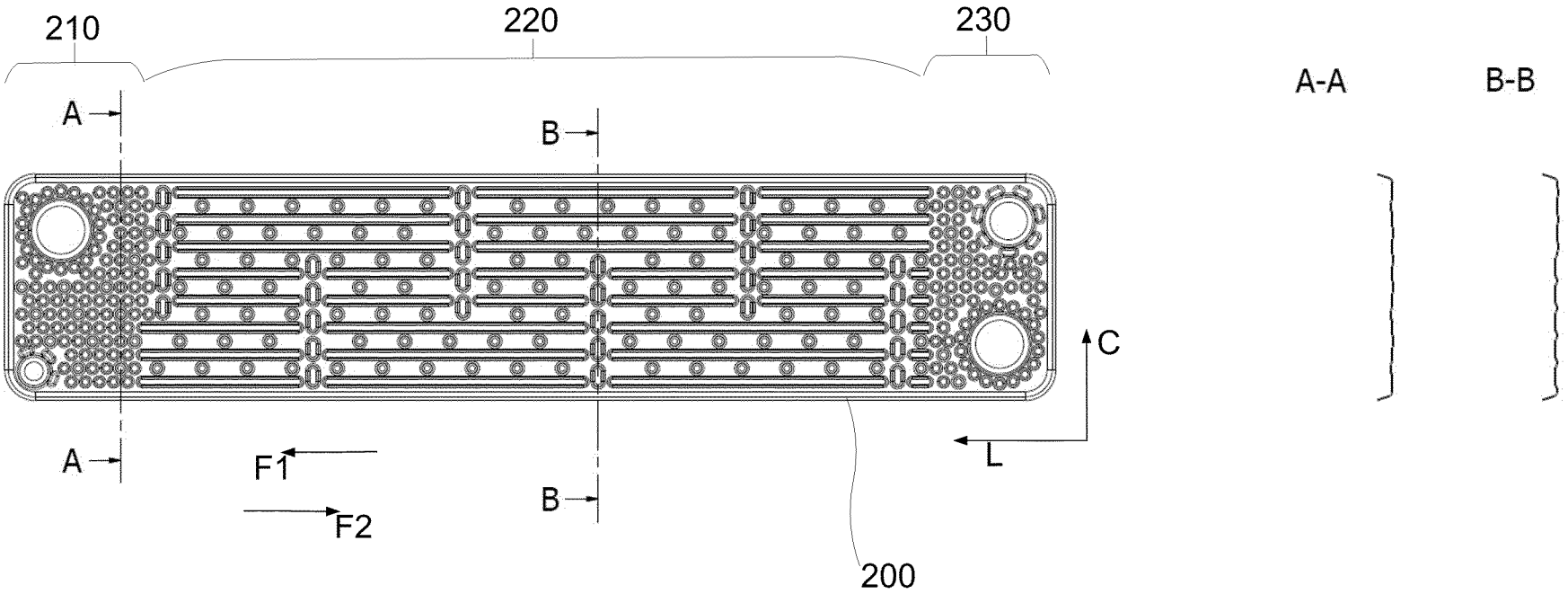
FIG. 8 is the top planar view shown in FIG. 7, with two sections A-A and B-B illustrated.

FIGS. 6-8 illustrate a second exemplifying heat exchanger plate 200, with corresponding first 201 and second 202 surfaces; regions 210, 220, 230; inlets 211, 231; outlets 212, 232; ridges 221, channels 222 and dimples 223. This second heat exchanger plate 200 offers similar advantages as the first plate 100.

As illustrated in the Figures, said protruding ridges 121, 221 preferably define at least three, preferably at least five (in the exemplifying plate 100, there are six channels 122, while there are seven channels 222 in the exemplifying plate 200), parallel and open-ended channels 122 extending in the first flow direction F1. The inventors have found that, for small heat exchangers, substantial advantages can be achieved already with two, in some cases at least three, such channels, while, for larger heat exchangers, more channels will provide better distribution of the first medium.

It is preferred that the channels 122 extend along substantially the whole second region 120 of the plate 100, along the longitudinal direction L. In particular, at least three of the channels 122 preferably each extend along at least 50%, preferably at least 60%, of the entire length, in the longitudinal direction L, of the plate 100.

It is preferred that the dimples 123 are arranged along at least three of the channels 122, preferably along all channels 122. Preferably, the dimples 123 are distributed along substantially the entire length of each individual channel 122, preferably substantially equidistantly. Preferably, each channel having dimples 123 is arranged with at least three, preferably at least five, preferably at least ten, such dimples 123 along its respective length. The dimples 123 of adjacent parallel channels 122 are preferably arranged so that they are displaced somewhat in the longitudinal direction L in relation to each other, as disclosed in the Figures.

Figure 5:
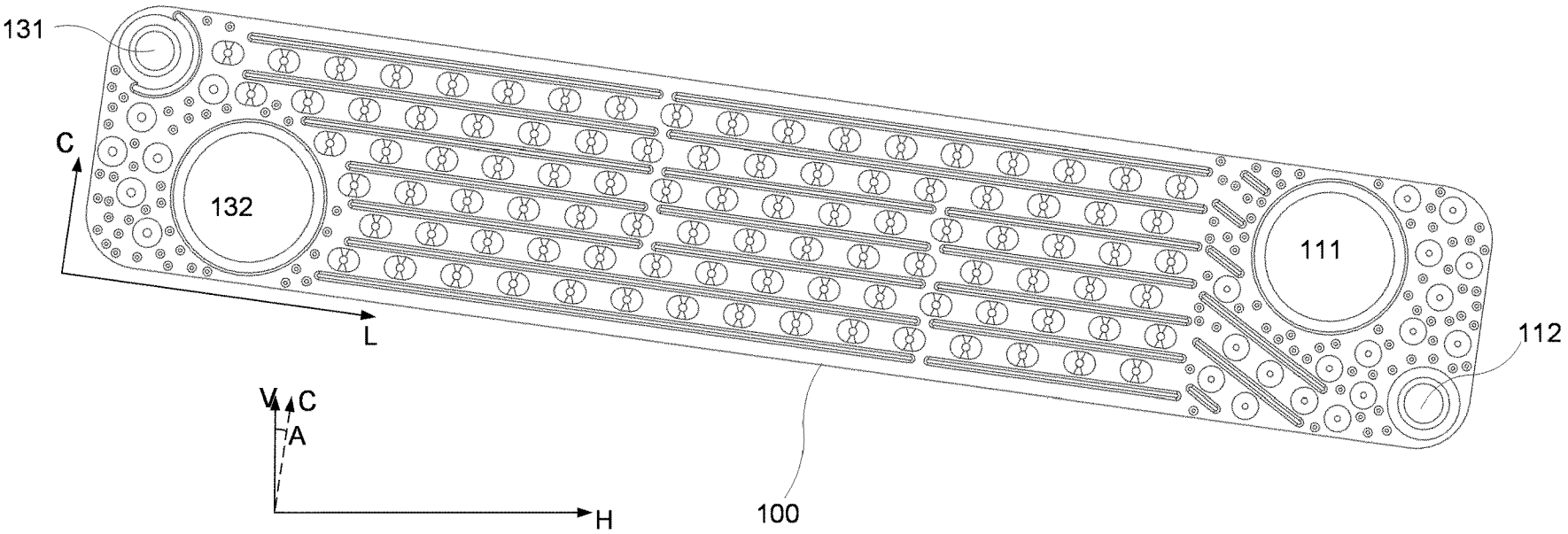
FIG. 5 is a planar side view of the heat exchanger plate shown in FIG. 1, shown in FIG. 5 in a preferred mounting orientation according to the present invention.

According to one preferred embodiment, the channels 122 are arranged with a shape permitting the channels 122, 103 (wherein channel 103 is formed by two opposed and mirrored open channel parts 122 as described above) to be completely emptied of the first medium, when the first medium is in liquid form and when the plate 100 is arranged in a mounted state for use, which mounted state is illustrated in FIG. 5. In this mounted state, the main plane of the plate 100 is substantially vertically oriented and with the cross direction C arranged at an angle A to the vertical V, and the longitudinal direction L inclined with the same angle A in relation to the horizontal direction H. The angle A is preferably between 5° and 40°. In order to be completely emptied of said first medium, the curvature of at least one respective side wall (in FIG. 5, the side wall facing upwards in the vertical direction) of each of the ridges 121 lacks local minima in the main plane and said cross direction C. Since the side wall of the ridge 121 forms the floor of the channel 122 when the plate 100 is mounted in the orientation illustrated in FIG. 5, the absence of such local minima guarantees that no liquid first medium will become trapped in such local minima during operation, and as a result the channels 122 can be completely emptied. Of course, at the longitudinal end of each ridge 121 the curvature of the ridge side wall in question bends downwards, but this does not count as a local minimum in the sense intended here.

That the channels 122 can be emptied completely when the plate 100 is in the slightly slanted mounted orientation as illustrated in FIG. 5 is an important aspect of the present invention, since it achieves good efficiency for the preferred condensing heat exchanger application described in fuller detail below, while still achieving the above-described advantages in terms of efficiency and robustness. Also, problems with overheating in areas where condensate is caught are avoided.

Preferably, at least one, preferably at least two neighbouring ones, of said ridges 121 is or are interrupted in at least one location along said first flow direction F1, defining a respective mixing zone 124 for the first medium flowing through corresponding neighbouring ones of said channels 122. Further preferably, the said mixing zone 124 interconnects all, or at least a majority, of said parallel channels 122 being present in said at least one location along the first flow direction F1. This provides good heat transfer efficiency while maintaining structural robustness of the heat exchanger. By distributing the first medium evenly across the cross-direction, plate 100 tensions are also kept to a minimum since the heat transfer process will be even. According to an alternative embodiment, the mixing zones 124 does not interconnect all of said parallel channels 122 being present in said at least one location along the first flow direction F1.

In particular, it is preferred that several such mixing zones 124 are arranged at different locations along the longitudinal direction L, such as equidistantly arranged. It is also preferred, as illustrated in the Figures, that neighbouring mixing zones 124 are displaced in relation to each other in the cross direction C, so that at least one channel 122 extends uninterrupted past at least one mixing zone.

In FIGS. 1-5, the mixing zones 124 are arranged as simple interruptions in the corresponding ridges 121, allowing the first medium to mix between channels 122 at the mixing zone 124 in question. However, as illustrated in FIGS. 6-8, it is alternatively preferred that the second surface 102 comprises at least one protruding barrier structure, preferably a ridge 225 extending in a direction substantially perpendicular to the second flow direction F2 and arranged in said mixing zone 224, defining a penetrable barrier for the second medium. The ridge 225 may alternatively comprise a connected barrier, not being penetrable to the second medium, but not extending across the whole cross-direction C so as to allow the first medium past but forcing it to move along a curvilinear path.

As mentioned above, the plate 100 preferably comprises, in reverse order along the main longitudinal direction L, regions 110,120 and 130. The region 130 may comprise, on the first surface 101, a first medium inlet region. The region 120 may comprise, on the first surface 101, a first medium transfer region. The region 110 may comprise, on the first surface 101, a first medium outlet region.

In a preferred embodiment, the first surface 101 comprises at least three mixing zones 124 of the above described type, arranged at different locations in the first flow direction F1, and wherein the said mixing zones 124 are more densely or closer arranged, as seen in the first flow direction F1, closer to the first medium inlet region 130 than further from the first medium inlet region 130. Note that such varying mixing region 124 density is not illustrated in the Figures.

Further in the preferred case with first medium inlet, transfer and outlet regions, the plate 100 preferably further comprises, on its opposite second surface 102, a second medium inlet region, overlapping with the first medium outlet region, and a second medium outlet region, overlapping with the first medium inlet region. This then defines a plate for use in a counter-flow heat exchanger. Alternatively, fora parallel-flow heat exchanger, the plate 100 may comprise, on the second surface 102, a second medium outlet region, overlapping with the first medium outlet region, and a second medium inlet region, overlapping with the first medium inlet region. For both heat exchanger types, the plate 100 preferably comprises, on the second surface 102, a second medium transfer region, overlapping with the first medium transfer region.

In particular, it is preferred that the said first medium inlet region comprises the first medium inlet 131, whereas the first medium outlet region comprises the first medium outlet 112. Then, it is preferred, in particular in case the heat exchanger is a condenser type heat exchanger, that the first medium inlet 131 has a larger, preferably at least two times the size, cross-section, in the main plane, than the first medium outlet 112. This cross-section size is hence the hole size in the preferred case in which the inlet 131 and the outlet 112 are through holes. Such configuration caters for an efficient construction when using a first medium which is condensed from gas phase to liquid phase as a result of the heat exchange.

Furthermore, it is preferred that the first medium inlet region comprises a pattern of protrusions 235 (see FIGS. 6 and 7), preferably short ridges extending with a component along the first medium flow direction F1, arranged to distribute the first medium to respective inlets of at least two of said parallel channels 222.

As to the first medium outlet region, it is preferred, as illustrated in FIGS. 1-3 and 5, that the said region comprises, on the first surface 101, at least two, preferably at least three, ridges 115, defining at least one, preferably at least two and preferably parallel, channels 116 running in a direction which is inclined to the first flow direction F1. Preferably, the channels 116 run in a direction which urges the first medium towards the first medium outlet 112. This provides a very efficient drainage (from a liquid-phase condensed first medium) of the heat exchanger, in particular when mounted in an inclined orientation such as the one illustrated in FIG. 5. Preferably, the first surface 101 channels 116 comprise second surface 102 dimples 117 along the channels 116.

According to a very preferred embodiment, apart from the above described ridges 121, 221 and dimples 123, 223 arranged in the channels 122, 222, at least one of the first 101 and second 102 surfaces, preferably both, comprises a respective plurality of additional protruding dimples. In the Figures, these additional dimples are illustrated as first surface 101, 201 dimples 113, 213 in the first region 110, 210; first surface 101, 201 dimples 133, 233 in the third region 130, 230; second surface 102, 202 dimples 114, 214 in the first region 110, 210; and second surface 102, 202 dimples 134, 234 in the third region 130, 230. It is preferred that the plate 100, 200 comprises all four or these types of dimples 113, 133, 114, 134; 213, 233, 214, 234.

These dimples share the joint purpose of distributing the respective medium across the plate 100; 200 respective surface 101, 102; 201, 202, increasing heat transfer efficiency; as well as providing mechanical stability to the heat exchanger.

In particular, it is preferred that the first surface 101, 201 comprises more, preferably at least twice as many, preferably at least three times as many, of said additional dimples 113, 133; 213, 233 as compared to the number of second surface 102, 202 additional dimples 114, 134; 214, 234. This has proven to achieve very efficient heat transfer, in particular in the case of a condenser-type heat exchanger, without jeopardizing its mechanical stability. Also, this achieves the possibility of handling larger medium pressure resistance to the heat exchanger.

As is clear from FIG. 4, the first medium channels 103 are lower (in a direction perpendicular to the main plane of each plate 100) than the second medium channels 104. This is particularly preferred in case of a condenser-type heat exchanger, in which the first medium is condensed as a result of the heat exchanging.

In particular, it is preferred that the respective height, perpendicular to the said main plane, of the above described dimples and ridges define a first flow height for the first medium, in said first medium channel 103, and a second flow height for the second medium, in said second channel 104. Then, it is preferred that the second flow height is at least 2 times, preferably at least 5 times, larger than the first flow height.

In order for all corresponding dimples and ridges to abut between adjacent, mirrored plates, it is realized that all dimples and ridges on either surface 101, 102; 201, 202 are preferably of the same height as measured from the said main plane.

In a particularly preferred embodiment, the first flow height, of the first medium channel 103, is at the most 1.5 mm, preferably at the most 1 mm, preferably at least 0.4 mm. This means that the height, including any additional material used to join the plates together, such as brazing material between abuting dimpels and ridges, of individual dimples and ridges is at the most 0.75 mm, preferably 0.50 mm, preferably at least 0.20 mm. In the preferred case of a brazed together structure (see below), it is preferred that the brazing material used, preferably in the form of a foil, such as a copper foil, before heating, is 0.01 mm to 0.08 mm thick.

As regards the parallel channels 122, 222, they are preferably between 5 and 20 mm, preferably between 8 and 15 mm, wide, in the cross direction C.

According to a very preferred embodiment, the plates 100, 200 together forming a heat exchanger by being brazed together in the stack structure described above, so that corresponding ones of said dimples and ridges of adjacent, mirrored plates 100, 200 are brazed together, top face against top face. This forms a very sturdy construction, without risking the integrity of the complicated channels formed between said ridges and dimples. In particular, the plates 100, 200 are preferably manufactured from stainless steel, and are brazed together using copper or nickel; or alternatively the plates 100, 200 may be manufactured from aluminium, and brazed together using aluminium. In practise, plates 100, 200 are arranged in the said stack structure, with brazing foil material in between. Then, the whole stack is subjected to heat in a furnace, causing the brazing material to melt and permanently join the plates 100, 200 together via the above described dimples and ridges.

In particular, such a heat exchanger according to the invention may preferably be a closed counter- or parallel flow heat exchanger, comprising a first medium inlet port 353 arranged to distribute the first medium to the respective first medium channels 103 in contact with said first surfaces 101 of said plates 100; a first medium outlet port 351 arranged to lead the first medium from said first channels 103 in contact with said first surfaces 101 and out from the heat exchanger; a second medium inlet port 350 arranged to distribute the second medium to the respective second medium channels 104 in contact with the second surfaces 102 of said plates; and a second medium outlet port 352 arranged to lead the second medium from said second medium channels 104 in contact with the second surfaces 102 and out from the heat exchanger. The corresponding is true regarding a heat exchanger using plates 200 as shown in FIGS. 6-8.

In particular, and as mentioned above, the heat exchanger is a condenser-type heat exchanger, arranged to heat exchange the first medium in gas phase to the second medium, so that the first medium condenses into liquid form. In this case, it is preferred that the heat exchanger is arranged so that the condensed, liquid first medium thereafter flows out from the first medium outlet port 351.

In particular, the present invention is useful in the specific case in which the first medium is a refrigerant, preferably a hydrocarbon, preferably propane. Similarly, the second medium may preferably be a liquid, preferably water.

Preferred uses of such a heat exchanger comprise use as a heat exchanger in a cooling apparatus, such as a freezer or refrigerator; in a heat pump for heating indoors air, water or similar in a property; for industrial heat exchanging and refrigeration purposes, such as within the food industry; and so on.

Preferably, a heat exchanger according to the invention is maximally 1 meter in its longest dimension.

Figure 9:
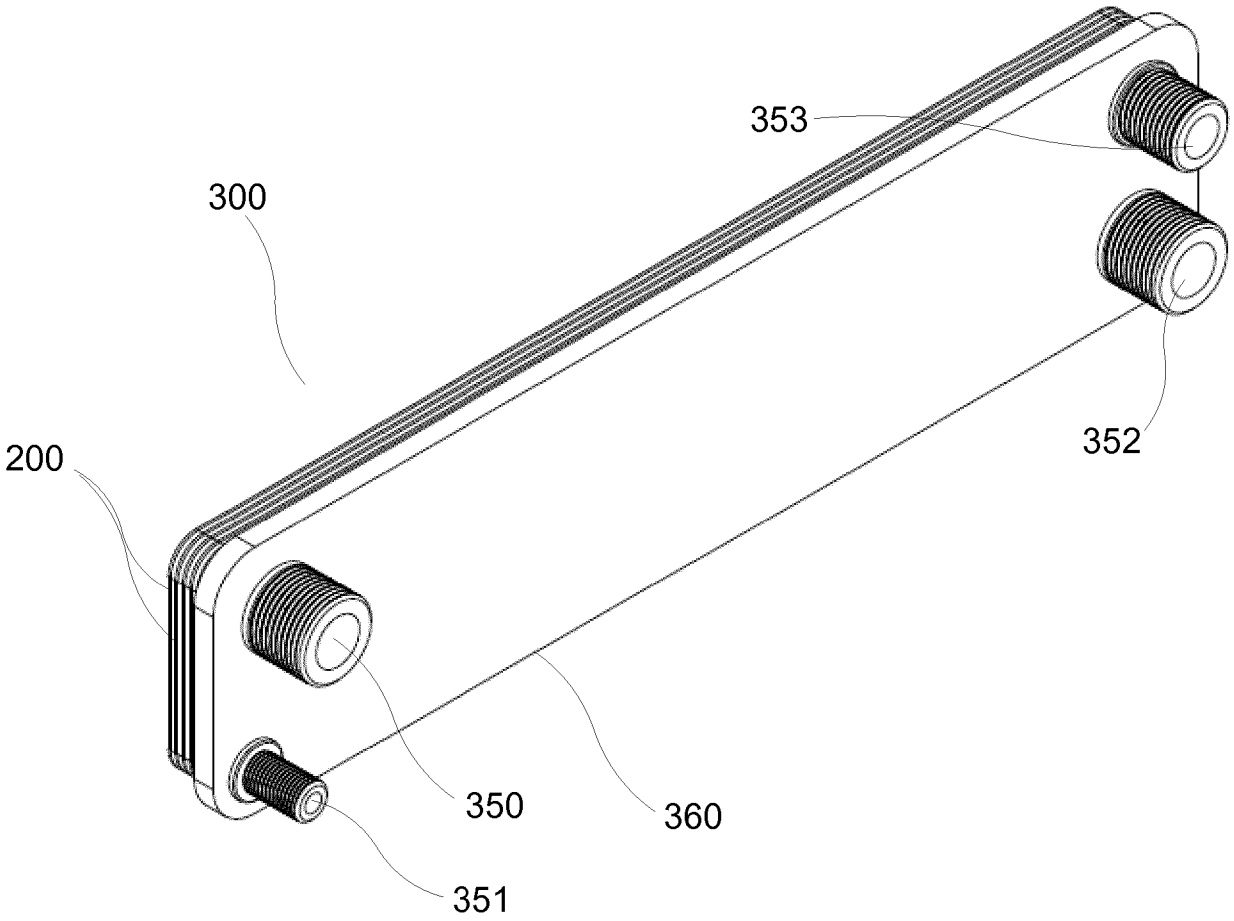
FIG. 9 is a perspective view of a heat exchanger according to the invention.
Figure 10:
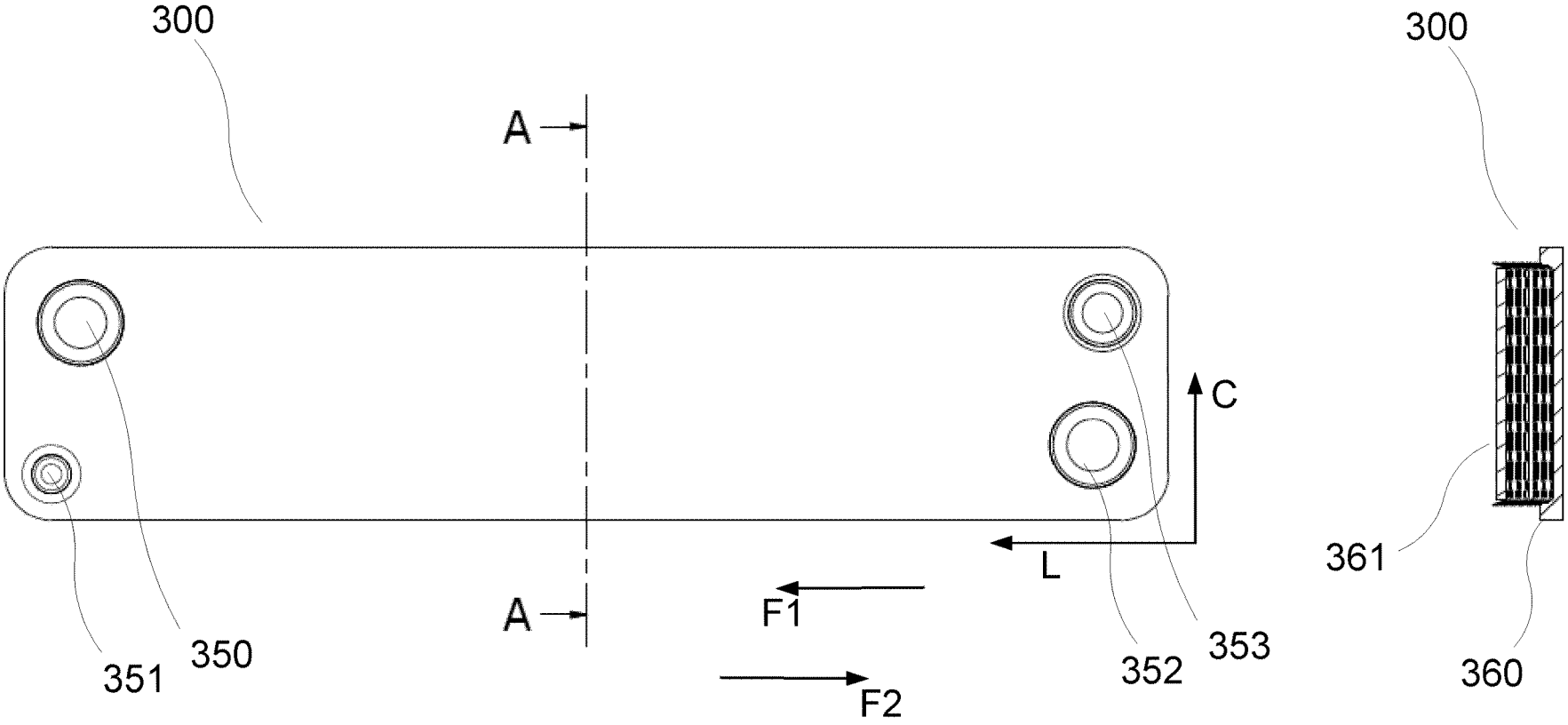
FIG. 10 is a top planar view of the heat exchanger shown in FIG. 9, with a section A-A illustrated.

FIGS. 9 and 10 show a heat exchanger 300, comprising a plurality (in the example shown, ten) heat exchanging plates 200 of the type illustrated in FIGS. 6-8 and described above. The plates 200 are stacked one on top of the other, with every other plate 200 being mirrored with respect to its adjacent neighbouring plates, also as described above. It is noted that the bent edge 205 of each plate 200 is not mirrored in the heat exchanger 300.

The first medium enters the heat exchanger 300 via a first medium inlet port 353, in communication with all the channels formed between respective adjacent pairs of plates 200, and delimited by their respective first surfaces 201. Preferably, these channels are parallel, so that the first medium flows in parallel flows along the first flow direction F1. The first medium is then collected from these channels and exit via a first medium outlet port 351.

The second medium enters the heat exchanger 300 via a second medium inlet port 350, in communication with all the channels formed between respective adjacent pairs of plates 200, and delimited by their respective second surfaces 202. Preferably, these channels are parallel, so that the second medium flows in parallel flows along the second flow direction F2. The second medium is then collected from these channels and exit via a second medium outlet port 352.

It is hence realized that the flow of both the first and second media flow in a parallel-flow manner, through a plurality of channels of said type, between pairs of individual plates 200 in said stack, between respective inlet and outlet ports.

As best seen in FIG. 10, the heat exchanger 300 also comprises end plates 360, 361 for delimiting the said channels on each extreme end of the plate 200 stack, guaranteeing that the heat exchanger 300 is entirely closed, and liquid and gas tight, apart from ports 350-353.

Above, preferred embodiments have been described. However, it is apparent to the skilled person that many modifications can be made to the disclosed embodiments without departing from the basic idea of the invention.

In general, the above described features of the plates 100, 200 and heat exchangers are freely combinable, as applicable.

Everything which has been said regarding plate 100 is equally relevant to plate 200 and vice versa, as applicable. Hence, the plate 200 may for instance also be arranged with a pattern of slanted ridges 115 as shown in plate 100, and so on.

The specific patterns of dimples and ridges illustrated in the Figures may vary, as long as the above-described design principles are respected.

Hence, the invention is not limited to the described embodiments, but can be varied within the scope of the enclosed claims.

The invention claimed is:

1. A plate for a heat exchanger, arranged to heat exchange a first medium in gas phase to a second medium, so that the first medium condenses into liquid form, the plate being associated with a main plane of extension and a main longitudinal direction and comprising:

a first heat transfer surface, extending substantially in parallel to said main plane and arranged to be in contact with the first medium, flowing along the first surface in a first flow direction parallel to the main longitudinal direction; and a second heat transfer surface, extending substantially in parallel to said main plane and arranged to be in contact with the second medium, flowing along the second surface in a second flow direction parallel to the main longitudinal direction, wherein the first surface comprises protruding ridges defining at least two parallel and open-ended channels extending in the first flow direction, wherein the second surface comprises a plurality of protruding dimples arranged in said channels between neighbouring respective pairs of said ridges, wherein a height, perpendicular to the main plane, of said ridges and dimples respectively define a first flow height for the first medium and a second flow height for the second medium, and a first set of ridges having at least two of said ridges immediately adjacent one another, each of the at least two of said ridges having a first interruption in at least one location spaced a first distance from a first side of the first surface and transverse to said first flow direction, each of the at least two of said ridges of the first set having a first uninterrupted section extending from the first side of the first surface to the first interruption, and a second set of ridges having at least two of said ridges immediately adjacent one another, each of the at least two of said ridges having a second interruption in at least one location spaced a second distance from the first side of the first surface and transverse to said first flow direction, the second distance being different than the first distance, at least one of the at least two of said ridges of the second set having a first uninterrupted section extending from the first side of the first surface to the second interruption.

2. The plate according to claim 1, wherein said protruding ridges define at least three parallel and open-ended channels extending in the first flow direction.

3. The plate according to claim 2, wherein the plate is associated with a cross direction, perpendicular to the main longitudinal direction and parallel to the main plane, and wherein a curvature of at least one respective side wall of each of said ridges lacks variations in the main plane and said cross direction.

4. The plate according to claim 1, wherein the plate is associated with a cross direction, perpendicular to the main longitudinal direction and parallel to the main plane, and wherein a curvature of at least one respective side wall of each of said ridges lacks variations in the main plane and in said cross direction.

5. The plate according to claim 1, wherein the first interruptions of the first set of ridges interconnect a majority of said parallel channels being present in said at least one location along the first flow direction.

6. The plate according to claim 1, wherein the plate comprises, in order along the main longitudinal direction, a first medium inlet region, a first medium transfer region and a first medium outlet region, and wherein the channels are arranged in the first medium transfer region.

7. The plate according to claim 6, wherein the plate further comprises a second medium inlet region, overlapping, on the opposite surface of the plate, with the first medium outlet region and a second medium outlet region, overlapping, on the opposite surface of the plate, with the first medium inlet region; or a second medium outlet region, overlapping, on the opposite surface of the plate, with the first medium outlet region and a second medium inlet region, overlapping, on the opposite surface of the plate, with the first medium inlet region; and a second medium transfer region, overlapping, on the opposite surface of the plate, with the first medium transfer region.

8. The plate according to claim 6, wherein the first medium inlet region comprises a pattern of protrusions arranged to distribute the first medium to respective inlets of at least two of said parallel channels.

9. The plate according to claim 1, wherein the first flow direction is substantially parallel to the main longitudinal direction.

10. The plate according to claim 1, wherein both the first and the second heat transfer surfaces comprise a respective plurality of additional protruding dimples, apart from the dimples arranged in said channels.

11. The plate according to claim 1, wherein the second flow height is at least 5 times larger than the first flow height.

12. The plate according to claim 1, wherein at least two neighbouring ridges are interrupted in at least one location along said first flow direction, defining a respective mixing zone for the first medium flowing through a corresponding neighbouring one of said channels.

13. The plate according to claim 1, wherein the first flow direction and the second flow direction are substantially parallel to the main longitudinal direction.

14. The plate according to claim 1, further comprising a pair of end plates spaced from each other in a direction perpendicular to the main plane, wherein the first heat transfer surface and the second heat transfer surface form a stack and the end plates are at a top and a bottom of the stack, respectively.

15. The plate according to claim 1, further comprising a third set of ridges having at least two of said ridges immediately adjacent one another, the third set of ridges being between the first set of ridges and second set of ridges, each of the at least two of said ridges having a third interruption spaced the first distance from the first side of the first surface and transverse to said first flow direction and a fourth interruption spaced the second distance from the first side of the first surface.

16. A plate for a heat exchanger, arranged to heat exchange a first medium in gas phase to a second medium, so that the first medium condenses into liquid form, the plate being associated with a main plane of extension and a main longitudinal direction and comprising:

a first heat transfer surface, extending substantially in parallel to said main plane and arranged to be in contact with the first medium, flowing along the first surface in a first flow direction parallel to the main longitudinal direction; and a second heat transfer surface, extending substantially in parallel to said main plane and arranged to be in contact with the second medium, flowing along the second surface in a second flow direction parallel to the main longitudinal direction, wherein the first surface comprises protruding ridges defining at least two parallel and open-ended channels extending in the first flow direction, wherein the second surface comprises a plurality of protruding dimples arranged in said channels between neighbouring respective pairs of said ridges, wherein a height, perpendicular to the main plane, of said ridges and dimples respectively define a first flow height for the first medium and a second flow height for the second medium, and a first set of ridges having at least three of said ridges immediately adjacent one another, each of the at least three of said ridges having a first interruption in at least one location spaced a first distance from a first side of the first surface and transverse to said first flow direction, each of the at least three of said ridges of the first set having a first section extending from the first side of the first surface to the first interruption, and a second set of ridges having at least three of said ridges immediately adjacent one another, each of the at least three of said ridges having a second interruption in at least one location spaced a second distance from the first side of the first surface and transverse to said first flow direction, the second distance being different than the first distance, at least one of the at least three of said ridges of the second set having a first section extending from the first side of the first surface to the second interruption, wherein the second surface comprises at least one protruding barrier structure extending in a direction substantially perpendicular to the second flow direction and arranged in the first interruptions of the first set of ridges, defining a penetrable barrier for the second medium.

* * * * *